US005635712A

United States Patent [19]

Scott, III et al.

[11] Patent Number: 5,635,712

[45] Date of Patent: Jun. 3, 1997

[54] METHOD FOR MONITORING THE HYDRAULIC FRACTURING OF A SUBTERRANEAN FORMATION

[75] Inventors: George L. Scott, III, Roswell, N.Mex.; Harry D. Smith, Jr., Houston, Tex.

[73] Assignee: Halliburton Company, Houston, Tex.

[21] Appl. No.: 434,669

[22] Filed: May 4, 1995

[51] Int. Cl.[6] ..... G01V 5/12

[52] U.S. Cl. ..... 250/260; 250/266

[58] Field of Search ..... 250/260, 259, 250/266; 166/308, 252.6

[56] References Cited

U.S. PATENT DOCUMENTS

| | | | |
|---|---|---|---|
| 4,328,705 | 5/1982 | Gringarten | 73/155 |
| 4,442,895 | 4/1984 | Lagus et al. | 166/250 |
| 4,731,531 | 3/1988 | Handke | 250/259 |
| 4,760,252 | 7/1988 | Albats et al. | 250/269 |
| 4,825,073 | 4/1989 | Smith, Jr. et al. | 250/260 |
| 4,832,121 | 5/1989 | Anderson | 166/254 |
| 4,857,729 | 8/1989 | Gadeken et al. | 250/260 |
| 4,883,956 | 11/1989 | Melcher et al. | 250/269 |
| 4,926,940 | 5/1990 | Stromswold | 166/250 X |
| 4,937,446 | 6/1990 | McKeon et al. | 250/270 |
| 4,939,361 | 7/1990 | Smith, Jr. et al. | 250/260 |
| 4,947,040 | 8/1990 | Mahdavi et al. | 250/266 |
| 4,965,697 | 10/1990 | Mosser et al. | 361/283 |
| 5,025,151 | 6/1991 | Melcher | 250/269 |
| 5,044,436 | 9/1991 | Megnani | 166/247 |
| 5,045,693 | 9/1991 | McKeon et al. | 250/270 |
| 5,051,581 | 9/1991 | Hertzog et al. | 250/266 |
| 5,081,351 | 1/1992 | Roscoe et al. | 250/270 |
| 5,094,808 | 3/1992 | Meeh | 376/158 |
| 5,095,983 | 3/1992 | Magnani | 166/250 |
| 5,097,123 | 3/1992 | Grau et al. | 250/270 |
| 5,105,080 | 4/1992 | Stoller et al. | 250/270 |
| 5,165,276 | 11/1992 | Thiercelin | 73/155 |
| 5,322,126 | 6/1994 | Scott, III | 166/308 |
| 5,404,010 | 4/1995 | Anderson et al. | 250/260 |
| 5,413,179 | 5/1995 | Scott, III | 166/308 |
| 5,442,173 | 8/1995 | Wraight | 250/260 |

FOREIGN PATENT DOCUMENTS

0234731B1 9/1987 European Pat. Off. .

OTHER PUBLICATIONS

"Gamma Ray Spectrometry Tool", Schlumberger booklet, (Sep. 1983).

Gadeken, et al., "Applications of the Compensated Spectral Natural Gamma Tool", Paper presented at the 25th Annual SPWLA Symposium in New Orleans, LA., Jun. 1984 (Published by JJJ, date unknown).

"Tubing Conveyed Perforating", Schlumberger Technical Data sheets TC01 (parts 01 to 12), (1987) no month.

Gardner, et al., "Acids Aided by Microemulsions Increase Permeability", *Petroleum Engineer International*, pp. 27–29 (Jul. 1989).

(List continued on next page.)

*Primary Examiner*—Carolyn E. Fields

[57] ABSTRACT

A method for real-time monitoring of fracture extension during a fracturing treatment of a producing subterranean formation. A radioactive tracer injector is coupled to and spaced from a gamma ray detector by a distance approximately equal to a distance from a point of injection during fracturing to a boundary between the desired interval to be fractured and an adjacent formation which it is desired not to fracture. A programmed central processing unit positioned at a surface location receives spectral signals generated by the gamma ray detector during the fracturing treatment and generates a fracture penetration signal and a fracture injection pump control signal that stops a fracture injection pump whenever the fracture extension signal indicates the presence of radioactive tracer material within the producing subterranean formation at the depth location of the gamma ray detector. The programmed central processing unit distinguishes between the presence of radioactive tracer material within the formation versus radioactive tracer material within the borehole itself.

28 Claims, 10 Drawing Sheets

OTHER PUBLICATIONS

Taylor III, et al., "Tracers Can Improve Hydraulic Fracturing", *Petroleum Engineer International*, pp. 22,24–25 (Jul. 1989).
"Nuclides and Isotopes: Chart of the Nuclides", GE Nuclear Energy, (14th ed. 1989) no month.
Gadeken, et al., "Improved Evaluation Techniques For Multipe Radioactive Tracer Applications", paper presented at the 12th International Logging Symposium of SAID, Paris, France (Oct. 1989), published by SAID–003 (date unknown).
"WFL Water Flow Log Service", Schlumberger brochure (Sep. 1990).
Brannon, et al., "Optimize Fracture Conductivity With Breaker Technology" *Petroleum Engineer International*, pp. 30, 32, 35–36 (Oct. 1990).
"Multiple Isotope Tracer Tool", Schlumberger brochure (Jul. 1991).
"Wireline–Conveyed Perforating", Schlumberger book (1991) no month.
Gadeken, et al., "The Interpretation of Radioactive–Tracer Logs Using Gamma–Ray Spectroscopy Measurements", *The Log Analyst*, pp. 24–34 (Jan.–Feb., 1991), originally presented at the 12th International Formation Evaluation Symposium, paper KK, Paris, (24–27 Oct. 1989).
Cleary, "Use of Supercomputer Modeling in Hydraulic Fracturing", *In Focus –Tight Gas Sands*, pp. 51–58 (vol. 8, No. 1, Jul. 1992).
Hunt, "Development of an In–Situ Stress Profile Model Using Drilling Parameters, Logs, Mechanical Rock Property Tests and Stress Tests", *In Focus –Tight Gas Sands*, pp. 61–66 (vol. 8, No. 1, Jul. 1992).
ProTechnology, A Regular Technical Review for Clients of the ProTechnics Company (Oct. 1994). "Multilayered Frac Model".
"Static v. Dynamic Modulus", *GRI Technical Summary*, Gas Research Institute (date unknown).
"Hydraulic Fracturing Research –New Concepts Will Change Industry Practices", *GRI Technology Focus* (date unknown).
"New Borehole Tool Provides More Accurate Downhole Density Determinations", *GRL Technology Focus* (date unknown).
Gartner, et al., "The Use of Nuclear Simulation Calculations To Support Applications In Radioactive Tracer Logging", published by IEEE–004 (date unknown).
"Schlumberger's FracHite Log", Schlumberger brochure (date unknown).
"Dual–Burst TDT Service", Schlumberger brochure (date unknown).
"Dual–Burst Thermal Decay Time Logging", Schlumberger booklet (date unknown).
"Gamma Spectrometry Tool", Schlumberger brochure (date unknown).
"Schlumberger's Natural Gamma Ray Spectrometry Log", Schlumberger brochure (date unknown).

METHOD FOR MONITORING THE HYDRAULIC FRACTURING OF A SUBTERRANEAN FORMATION

BACKGROUND OF THE INVENTION

This invention relates generally to hydraulic fracturing operations, and more specifically relates to the field of systems for real-time monitoring and control of downhole hydraulic fracturing operation in petroleum reservoirs.

Various fracture-stimulation techniques are designed and employed in the petroleum industry for the purpose of placing sand proppant in hydraulically induced fractures to enhance oil or gas flow through a reservoir to the wellbore. Hydraulic fracturing of petroleum reservoirs typically improves fluid flow to the wellbore, thus increasing production rates and ultimate recoverable reserves. A hydraulic fracture is created by injecting a fluid, such as a polymer gelled-water slurry with sand proppant, down the borehole and into the targeted reservoir interval at an injection rate and pressure sufficient to cause the reservoir rock within the selected depth interval to fracture in a vertical plane passing through the wellbore. A sand proppant is typically introduced into the fracturing fluid to prevent fracture closure after completion of the treatment and to optimize fracture conductivity.

A hydraulic fracturing treatment is a capital-intensive process. In addition to the substantial cost of a fracturing treatment itself, substantial oil and gas revenues may be gained as a result of a technically successful stimulation job, or lost due to an unsuccessful treatment. The effectiveness of a fracturing treatment depends on numerous critical design parameters, including reservoir rock properties, the vertical proximity of water-productive zones, and the presence or absence of strata that act as barriers. Unsuccessful fracturing treatments typically result from inefficient placement of sand proppant in the induced fracture with respect to the targeted reservoir interval, which also sometimes results in excessive water production due to treating "out of zone."

The formation is composed of rock layers, or strata, which include the objective petroleum reservoir, which is often a sandstone, limestone, or dolomite interval. When a fracture propagates vertically out of the defined hydrocarbon reservoir boundaries into adjacent water-productive zones, the well may be mined by excessive water flow into the wellbore, or added expenses and disposal problems may be caused by the need to safely dispose of the produced water. Also, if the fracture propagates into an adjacent non-productive formation, the sand proppant may be wasted in areas outside the objective formation, and the treatment may not be effective. Either situation may result in dire economic consequences to the well operator. Although it is sometimes possible to save a well that has been fractured "out of zone" such remedial efforts are typically extensive, risky, and costly.

An economical and successful fracture stimulation requires maximum controlled placement of fracture proppant in the reservoir zone, while avoiding treating into water-producing strata. The increased production revenue from successful fracturing treatments amounts to many millions of dollars each year. A successful fracturing treatment is typically evidenced by increased reservoir production performance resulting from concentrated placement of sand proppant in the petroleum reservoir within the induced hydraulic fracture.

Conversely, inefficient fracturing treatments cost the petroleum industry many millions of dollars each year both in foregone revenue from non-production of valuable hydrocarbons and in lost capital expenses associated with well drilling and completion. Indeed, some wells can be mined entirely from poor fracturing.

Known systems exist which provide real-time monitoring of fracture growth during hydraulic fracturing treatment. Such known systems pump fracturing fluid to the point of injection, provide a radioactive tracer at the point of injection by activating the fracturing fluid and/or proppant using a neutron source or by explosive injection of conventional tracer material, and then monitor the propagation of the radioactive fracturing fluid and/or proppant during the fracturing process by employing a plurality of gamma ray detectors, with conventional signal processing of the spectral data, positioned above and below the point of injection.

Such systems, while providing real-time monitoring of fracture growth during a hydraulic fracturing treatment do not distinguish between tracer material within the borehole versus tracer material within the formation itself.

The present invention is directed to improving upon the known techniques and systems described above by providing a new method for monitoring the hydraulic fracturing of a producing subterranean formation. The method may be utilized to control the fracturing operation; for example, by extending or reducing the injection period as a function of monitored parameters in the subterranean zone of interest.

SUMMARY OF THE INVENTION

In accordance with one aspect of the present invention there is provided a method for monitoring the hydraulic fracturing of a producing subterranean formation. In this embodiment, a spectral gamma ray detector will be utilized prior to the commencement of a fracturing treatment to determine the relationship between the radial position of a radioactive material within a producing subterranean formation and the detected spectrum. Also prior to the commencement of the fracturing treatment, the background natural gamma ray spectrum at a single location adjacent to a boundary between the producing subterranean formation and another subterranean formation is detected. The producing subterranean formation then receives a fracturing treatment by pumping a mixture of particles and fluid into the borehole to create hydraulic pressure on the producing subterranean formation at the fracturing depth. Radioactive tracer material is added to the mixture as the mixture enters the producing subterranean formation at the fracturing depth. A fracturing spectrum is detected at the single location while the mixture is being pumped. The fracturing spectrum is processed by subtracting the background spectrum from the fracturing spectrum to generate a corrected fracturing spectrum representing the presence of tracer inside and/or outside the casing; or alternatively, containing spectral information representing the radial distance of penetration of the radioactive tracer material from the detector. The corrected fracturing spectrum is then processed to determine a presence or an absence of the radioactive tracer material within the producing formation at the depth of the single detector by means of the determined relationship between the radial location of the radioactive material and the detected spectrum. If the presence of the radioactive material within the producing formation is determined, then the fracturing treatment of the producing subterranean formation is stopped.

BRIEF DESCRIPTION OF THE DRAWINGS

The present invention will become more fully understood from the following detailed description of the preferred embodiments, taken in conjunction with the accompanying drawings in which.

DETAILED DESCRIPTION OF PREFERRED EMBODIMENTS

Figure 1:
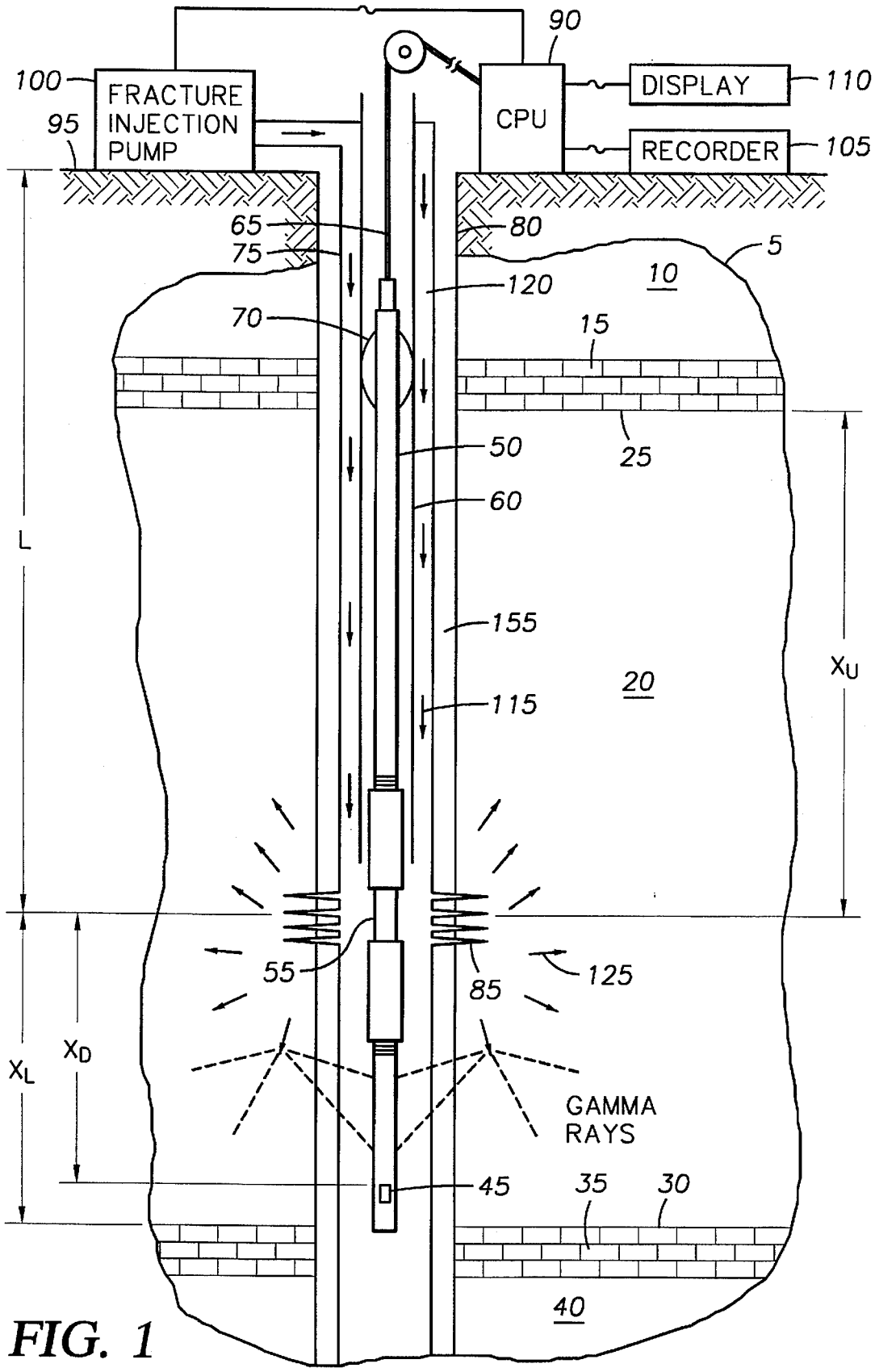
FIG. 1 schematically illustrates a first embodiment of the present invention.

Turning now to the drawings and referring initially to FIGS. 1–5, a first exemplary embodiment of the present invention will now be described.

In preparation for a fracturing treatment at an injection point located at a fracturing depth L, a conventional logging tool is employed to ascertain the location and composition of the various subterranean layers within a formation 5. For purposes of illustration, the formation 5 includes an upper water-productive formation 10, an upper rock strata formation 15, a producing subterranean formation 20 including an upper boundary 25, positioned above the fracturing depth L by a distance $X_U$, and a lower boundary 30, positioned below the fracturing depth L by a distance $X_L$, a lower rock strata formation 35, and a lower water-productive formation 40. Also for purposes of illustration, the upper rock strata formation 15 consists of an extensive barrier to penetration by a fracturing treatment while the lower rock strata formation 35 does not. Consequently a fracturing treatment "out of zone" will be of concern primarily only with respect to the lower water-productive formation 40, since a fracture of the lower rock strata formation 35 would introduce water-flow from the water-productive formation 40 into the wellbore.

Therefore in order to prevent an "out of zone" fracturing treatment, the fracture extension in the direction of the lower rock strata formation 35 must be stopped short of the lower boundary 30 defined by the interface between the producing subterranean formation 20 and the lower rock strata formation 35.

In order to monitor the fracture extension in the direction of the lower rock strata formation 35 and thereby stop the fracturing operation before it reaches the lower rock strata formation 35, a gamma detector 45 is positioned on the lower side of a logging tool 50, adjacent to the lower rock strata formation 35, and spaced apart from a conventional radioactive tracer injector 55, which is positioned at an injection point located at a fracturing depth L, by a distance $X_D$. The distance $X_D$ is selected to ensure that the fracturing operation is stopped once the fracture extension reaches a depth just short of the lower boundary 30 by detection of the presence of radioactive tracer material within the producing subterranean formation 20 at the depth location of the gamma detector 45. Thus the distance $X_D$ is selected to be approximately equal to the distance from the fracturing depth L to the boundary of the adjacent subterranean formation for which a fracturing treatment would present the possibility of undesirable water flow from a water-productive formation. This distance may also be selected in response to selected characteristics of the producing subterranean formation 20, of the fracturing fluid, and the rate of injection of the fracturing fluid. In one exemplary embodiment, the distance $X_D$ is selected to be 1 to 2 meters less than the distance from the fracturing depth L to the boundary of the adjacent subterranean formation. Thus, for the formation 5, the distance $X_D$ is selected to be 1 to 2 meters less than the distance $X_L$ from the fracturing depth L to the lower boundary 30 in order to provide an acceptable margin of safety.

The depicted arrangement in FIG. 1 is illustrative only, as the gamma ray detector 45 could also be placed above the injection point at the fracturing depth L, and therefore above the tracer injector 55 on the logging tool 50, for the situation where the boundary of interest was positioned above the injection point.

During a fracturing treatment, the logging tool 50 is suspended within a cased wellbore, and preferably within a steel tubing string 60, preferably by a conventional logging cable 65. The logging tool 50 may be centrally positioned and stabilized within the tubing string 60 by a bow-spring centralizer 70. Additionally, the tubing string 60 may be centrally positioned within the well borehole. Although the radioactive tracer injector 55 and the gamma detector 45 are illustrated as being housed within the logging tool 50, they may also be connected to one another by a logging cable. The steel tubing string 60, suspended within a steel production casing 75, within the well borehole 80, traverses the formation 5. The steel production casing 75 includes a number of perforations 85 in preparation for the fracturing treatment, with the perforations 85 extending into the producing subterranean formation 20. The steel tubing string 60 does not extend to the point of injection at the fracturing depth L thereby permitting the tracer injector 55 to introduce radioactive tracer material proximate, or generally at, the point of injection.

The fracturing treatment is controlled by a programmed central processing unit 90 positioned at a surface location 95. The programmed central processing unit 90 communicates with the tracer injector 55 and gamma detector 45, in a conventional manner, by means of the logging cable 65. The programmed central processing unit 90 also preferably communicates with a fracture injection pump 100, a recorder 105, and a display unit 110 also positioned at the surface location 95.

Figure 2:
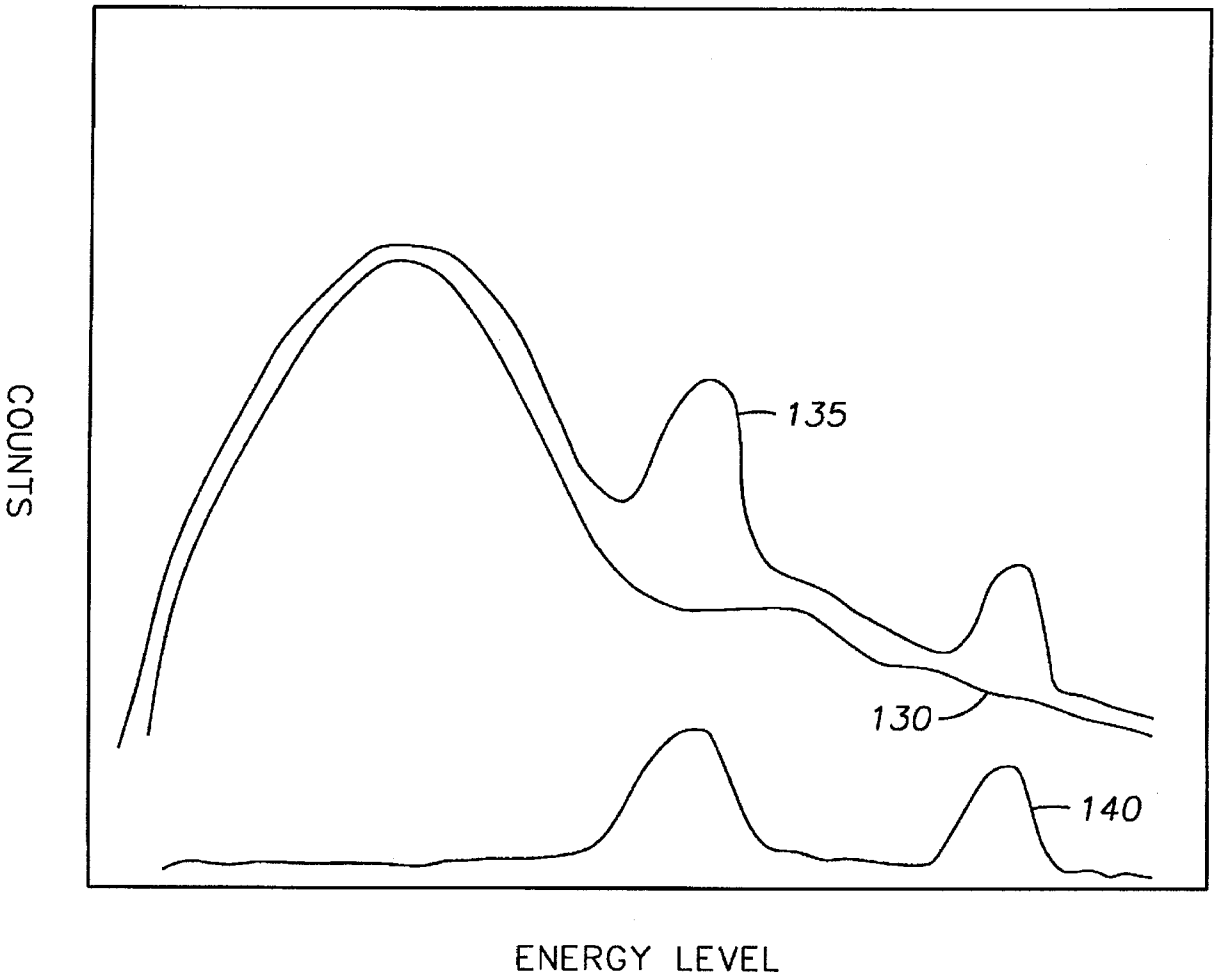
FIG. 2 graphically illustrates a typical background spectrum, fracturing spectrum signal, and corrected fracturing spectrum signals.

Prior to the initiation of the fracturing treatment, in a preferred implementation, a background measurement of the gamma radiation spectrum will be taken by the gamma detector 45, in a well known manner, in order to establish a baseline over which the gamma ray counts and tracer-specific energy levels can be detected during the fracturing treatment. The background measurement is made with the gamma detector 45 positioned within the well borehole 80 adjacent to the lower boundary 30 as illustrated in FIG. 1. Preferably, this gamma ray detector 45 will be a conventional gamma ray detector configured to detect a spectrum of impinging gamma ray energies and to output a spectrum representative of the energies detected. Where a background measurement of gamma radiation is taken, a signal representative of that measurement will be transmitted to the programmed central processing unit 90 in the form of a background spectrum signal 130 representative of the background spectrum. A typical exemplary background spectrum signal 130 is illustrated in FIG. 2. Such a background spectrum will typically be comprised of the Uranium, Thorium, and Potassium isotopes and/or other radioactive trace materials which naturally exist in all downhole formations. In this preferred embodiment, the programmed central processing unit 90 stores the background spectrum signal 130 in random access memory for subsequent use in processing spectral signals obtained during the fracturing treatment.

During the fracturing treatment, the fracture injection pump 100 is activated by the programmed central processing unit 90 and a mixture of fracturing fluid and proppant 115 is thereby pumped into the well, via an annulus 120, by the fracture injection pump 100 under the control of the programmed central processing unit 90.

In a preferred embodiment, the programmed central processing unit 90 will include signals input from a multichannel analyzer as is well known in the art. Preferably this analyzer will be located at a downhole location; however, as will be recognized to those skilled in the art, an uphole assembly may also be utilized to count impinging gamma rays as a function of energy level. In one preferred embodiment, the programmed central processing unit 90 will also include a programmed general purpose computer, as is well known to those skilled in the art for controlling and monitoring well logging and similar operations. Such a programmed central processing unit is capable of performing all of the signal processing and control functions on a real-time basis.

At the fracturing depth L, the tracer injector 55 injects a small quantity of radioactive tracer material 125 into the fracturing fluid and proppant mixture 115 in a well known manner. It is further possible to inject multiple tracers, in a well known manner, to thereby permit the independent monitoring of the movement of the fracturing fluid and the proppant, wherein a first tracer will be associated with the fracturing fluid and a second tracer will be associated with the proppant.

The rate of injection of the radioactive tracer material 125 into the fracturing fluid and proppant mixture 115 is typically a few tenths of a milliCurie of activity per thousand gallons of the fracturing fluid and proppant mixture 115. In a preferred embodiment, the pumped fracturing fluid and proppant mixture 115 is tagged with the radioactive tracer material 125 at a constant rate of 3 to 5 tenths of a milliCurie of activity per thousand gallons of the mixture of fracturing fluid and proppant 115.

In a preferred embodiment, a tracer injector 55 is utilized to introduce the tracer material into the fracturing fluid. The design and use of tracer injectors is known in the art and examples of same are described in SPE paper no. 701, entitled "The Fluid Travel Log", prepared by T. Walker et al., and presented in New Orleans, La. in 1963 or the "Tracerlog" injector described in the 1984 Dresser Atlas Services Catalog, at page 26. Such a tracer injector 55 will be modified, in a well known manner, to inject radioactive tracer material 125, compatible with the fracturing fluid and/or proppant, at a generally constant rate of 0.3 to 0.5 milliCuries per thousand gallons of the fracturing fluid and proppant mixture 115. The radioactive tracer material 125 will be injected beginning with the start of the fracturing operation, and in the preferred embodiment, continue throughout the fracturing operation. If the quantity of radioactive tracer material 125 is limited, then it will be injected beginning with the early part of the fracturing operation. It should be noted that there are other possible means for initiating and sustaining the flow of radioactive material from the logging tool such as, for example, pressure exerted on the tubing containing the tool causing the tracer material to be forced from the tool or tubing and into the perforation.

The radioactive tracer material 125 then passes through the perforations 85 along with the fracturing fluid and proppant mixture 115 and into the fracture that the fracturing fluid and proppant mixture 115 is forcing open in the producing subterranean formation 20.

Travel of the radioactive tracer material 125 below the point of injection at the fracturing depth L may be prevented, in a well known manner, by the use of a packer (not illustrated) on the logging tool 50 or by placement of an immobile material, such as high density drilling mud within the well borehole 80 below the fracturing depth L. Consequently the gamma detector 45, when positioned below the point of injection at the fracturing depth L, as necessitated by the composition of the formation 5 in the exemplary embodiment, will not usually detect the presence of radioactive tracer material 125 within the borehole 80 at the depth location of the gamma detector 45. The radioactive tracer material 125 is characterized by distinctive gamma energy spectra, which are easily measured by the gamma detector 45. A variety of gamma-emitting tracer isotopes are suitable for use as radioactive tracer material 125, including but not limited to Gold$^{198}$, Xenon$^{133}$, Iodine$^{131}$, Rubidium$^{86}$, Chromium$^{51}$, Iron$^{59}$, Antimony$^{124}$, Strontium$^{85}$, Cobalt$^{58}$, Iridium$^{192}$, Scandium$^{46}$, Zinc$^{65}$, Silver$^{110°}$ , Cobalt$^{57}$, Cobalt$^{60}$, and Krypton$^{85}$. If more than one tracer isotope is used, the gamma ray energy signatures should be carefully considered. In a preferred embodiment, each tracer signature should be significantly different from the others used in order to be able to distinguish them from one another during subsequent signal processing by the programmed central processing unit 90.

During the fracturing treatment, the radioactive tracer material 125 regularly emits gamma rays, which move through the producing subterranean formation 20 in a random direction for a distance of perhaps one meter, and in the process are scattered and/or absorbed by the producing subterranean formation 20. As shown in FIG. 1, some of those gamma photons will pass through the producing subterranean formation 20 and steel tubular elements such as the casing 75 and tubing 60 and strike the gamma detector 45. However, because it is unlikely that the gamma rays will travel a large distance without being absorbed, and since the gamma detector 45 will be more likely to detect gamma rays originating close to it, most of the gamma rays which impinge upon the gamma detector 45 will originate in the radioactive tracer material 125 located at approximately the same depth location as the gamma detector 45. In this manner, the gamma detector 45 is able to detect the fracture extension once it has progressed to the depth location of the gamma detector 45, this detection permits stoppage of the fracturing treatment before an "out of zone" treatment has occurred.

The gamma detector 45, of conventional construction, comprises a thallium activated sodium iodide crystal coupled to a low noise photomultiplier and associated electronics. Such a gamma detector may be easily incorporated into the logging tool 50 using conventional assembly techniques or may simply be suspended from the logging tool 50 by a logging cable for formations 5 in which the spacing requirements are excessively large.

In a particularly preferred embodiment, the gamma detector 45 will be a conventional detector adapted for gamma ray spectroscopy. Such a spectral gamma detector 45 will include an appropriately sized crystal of, for example, sodium iodide and an appropriate low noise photomultiplier assembly coupled thereto. Where such a spectral gamma detector 45 is used, the logging tool preferably will include a tool case housing having, over the gamma detector 45, a material having a low atomic number (Z) and a low density to facilitate observation and measurement of photoelectric absorption of low energy gamma rays. Such a tool case is described in U.S. Pat. No. 4,504,736, the disclosure of which is incorporated herein by reference. For high temperature, high pressure applications, the tool housing could be made of titanium. In other instances, a smaller diameter steel tool housing can be used if photoelectric measurements are of relatively less importance.

In this particularly preferred embodiment, throughout the fracturing treatment, the spectral gamma detector 45 continuously generates, in a well known manner, a fracturing spectrum signal 135 representative of the gamma radiation spectrum present during the fracturing treatment. Incident gamma rays, whether from natural radiation, or from tracers are detected by the crystal, the scintillations in which are coupled to the low noise photomultiplier for producing electrical pulses having amplitudes proportional to the energies of the impinging gamma rays. Preferably the detector gain is maintained to within ±0.5% by a well known coincidence stabilization technique which utilizes a stabilizer circuit which requires a much smaller secondary crystal in close proximity to the larger primary crystal and containing an embedded $^{241}$Am source. When $^{241}$Am decays, a 60 KeV gamma ray and a high energy alpha particle are emitted essentially simultaneously. The alpha particles are detected with virtually 100% efficiency in the smaller secondary crystal, whereas most of the 60 KeV gamma rays escape. Approximately 20% of these gamma rays are typically detected in the larger primary crystal. Since these gamma rays are from the stabilizer are in coincidence with the alpha particles, they can be isolated from all other gamma rays detected in the larger primary crystal with better than 99% efficiency whereby the gamma ray coincidence spectrum will contain only 60 KeV stabilizer gamma rays. The resulting detector 45 is therefore unaffected by changes in the number or distribution of external gamma rays. In addition, the anti-coincidence spectrum in the larger primary crystal contains gamma radiation originating exclusively from the formation and borehole region surrounding the tool, removing the need for stripping out stabilizer counts. Of course, other well known gain stabilization techniques could be used if desired.

After amplification by the photomultiplier, both the coincidence and anti-coincidence dam pulses may be digitized in the spectral gamma detector 45 by analog-to-digital conversion, accumulated in a data accumulator, and sorted by a microprocessor which synchronizes transmission of data at regular intervals to the CPU 90. Alternatively, all of the A/D conversion, accumulation, and sorting may be performed by the CPU 90. The coincidence (stabilizer) events are converted into a 256 channel spectrum which spans the energy range from 0–350 KeV to enable the conventional automatic downhole gain stabilizer feedback circuit to maintain system gain within ±0.5%. The anti-coincidence (formation and borehole gamma radiation) events are converted into two 256 channel spectra, one spectrum which spans the low energy range from 0–350 KeV and the other spectrum which spans a high energy range from 0–3000 KeV. The three spectra are accumulated in a data accumulator and then transmitted to the CPU 90. Alternatively, the three spectra may be generated directly by the CPU 90. At the surface, the data are recorded on the recorder 105, which may be a convectional magnetic tape recorder, and are also simultaneously displayed on the display 110. The two formation spectra, high energy and low energy, are further processed by the CPU 90.

The high energy spectrum is typically broken down into between 9 and 13 continuous energy windows selected to encompass specific peaks from Potassium, Uranium, and Thorium between 150 KeV and 3 MeV, and also to encompass the specific energy peaks of the radioactive tracers used in the fracturing operation. The term "window", as used herein, refers to a preselected range of gamma ray energies.

In the low energy spectrum, typically at least two windows are selected—one to measure gamma rays in an energy range sensitive to photoelectric absorption in iron, and another sensitive principally to Compton scattered radiation but not to photoelectric effects.

A typical fracturing spectrum signal 135 is illustrated in FIG. 2. Because the radioactive tracer material 125 will be selected to include energy peaks not anticipated to be prevalent in the producing subterranean formation 20, an increase in count rates in the tracer energy spectra, including the full energy peaks of the radioactive tracer material 125, will be indicative of radioactive tracer material 125, and therefore also of the carrier fracturing fluid and/or proppant, proximate the detector 45. Where a simple gamma ray detector is utilized, an increase in gamma ray count rate can be understood to indicate the movement of a gamma ray emitting material, such as the radioactive tracer material 125 and the fracturing fluid and/or proppant, traveling to a location proximate the detector 45. Thus, either method yields a signal indicative of the presence of radioactive tracer material 125, and therefore of the fracturing fluid and/or proppant proximate the depth location of the detector 45.

Where a background signal has been generated, additional refinement of the method is possible. In this example, the programmed central processing unit 90 receives the fracturing spectrum signal 135 and subtracts the background spectrum signal 130, having been previously stored in memory, from the fracturing spectrum signal 135, in a conventional manner, to generate a background corrected fracturing spectrum signal 140 representative of the gamma radiation spectrum present during the fracturing treatment corrected for background radiation. A typical background corrected fracturing spectrum signal 140 is illustrated in FIG. 2.

The programmed central processing unit 90 will then process either the fracturing spectrum signal 135 or, preferably, the corrected fracturing spectrum signal 140 to generate a fracture penetration signal representative of the mean radial distance of the penetration of the tracer material 125 into the producing subterranean formation 20 at the depth location of the detector 45. This technique is described in U.S. Pat. No. 4,825,073, issued Apr. 25, 1989, to Harry D. Smith, Jr. and Larry L. Gadeken, and entitled "Method for Determining Depth of Penetration of Radioactive Tracers in Formation Fractures". The disclosure of U.S. Pat. No. 4,825,073 is incorporated herein by reference. Using this method, the mean radial distance of tracer penetration may be determined by calculation of the amount of Compton scattering relative to unscattered gamma rays in the measured spectrum.

The method for obtaining the mean radial distance of penetration is based upon the well known phenomenon that the farther away a gamma ray source is located from a gamma detector, the more its spectrum will be degraded.

More specifically the mean radial distance of tracer penetration is provided by first selecting a higher energy window A to include the peaks of primary radiation which reach the gamma detector 45 with minimal Compton scattering collisions. A lower energy window B is then selected for detecting gamma radiation which has been significantly Compton degraded through collisions prior to detection. If CA(R) is defined as the count rate recorded in window A for an arbitrary R, where R is defined as the mean radial distance of tracer from the gamma detector 45, and Cs(R) is the count rate recorded in energy window B for an arbitrary R, then it can be seen that:

$$C_A(R_2)/C_B(R_2)<C_A(R_1)/C_B(R_1) \text{ for } R_2>R_1 \quad (1)$$

The ratio inequalities $C_A/C_B$ which result are due to the fact that a larger fraction of the primary gamma radiation is degraded by collisions with the intervening material as the distance R between the tracer location and the gamma detector 45 is increased. Thus by calibrating a system in terms of the amount of spectral degradation as a function of the radial distance R, a method is provided for determining the radial penetration of the tracer.

Caution should be exercised, however, in choosing the lower energy limit of the software or hardware such that very low energy photoelectric effects caused by the well casing will be eliminated.

Table I below illustrates several exemplary embodiments of high and low energy windows A and B for the gamma detector 45 for tracer materials Scandium-46, Ir-192, and Au-198.

TABLE I

| Tracer Isotope | High Energy Window (KeV) | Low energy Window (KeV) |
|---|---|---|
| Sc-46 | 825–1250 | 175–700 |
| Ir-192 | 275–700 | 175–275 |
| Au-198 | 325–500 | 175–325 |

The relationship between the amount of Compton scattering relative to unscattered gamma rays in the measured spectrum can be calibrated for the spectral gamma detector 45, in a known manner, to provide an indication of the relative mean radial position of the radioactive tracer material 125. Preferably, a weighted-least-squares technique will be utilized, such as described in U.S. Pat. No. 3,739,171 and U.S. Pat. No. 4,585,939, the disclosures of which are incorporated herein by reference, to process the gamma ray counts in selected energy windows to yield the indication of the mean radial distance of penetration. The weighted-least-squares method is particularly preferred when more than one tracer in employed, whereby the mean radial distance of penetration for all of the tracers are determined.

The results obtained using the above method are significantly enhanced in many situations if the natural gamma ray background spectrum 130 is removed prior to determining the shape of the particular tracer spectrum (previously referred to as the background corrected fracturing spectrum 140). Accordingly, the natural gamma ray spectra 130, as evidenced by the Potassium, Uranium, and Thorium window count rates, and those of their decay products or daughter products, can be obtained prior to tracer injection, and then subtracted from the observed fracturing spectrum 135 prior to determining the shape of the particular tracer gamma my spectrum.

Figure 3:
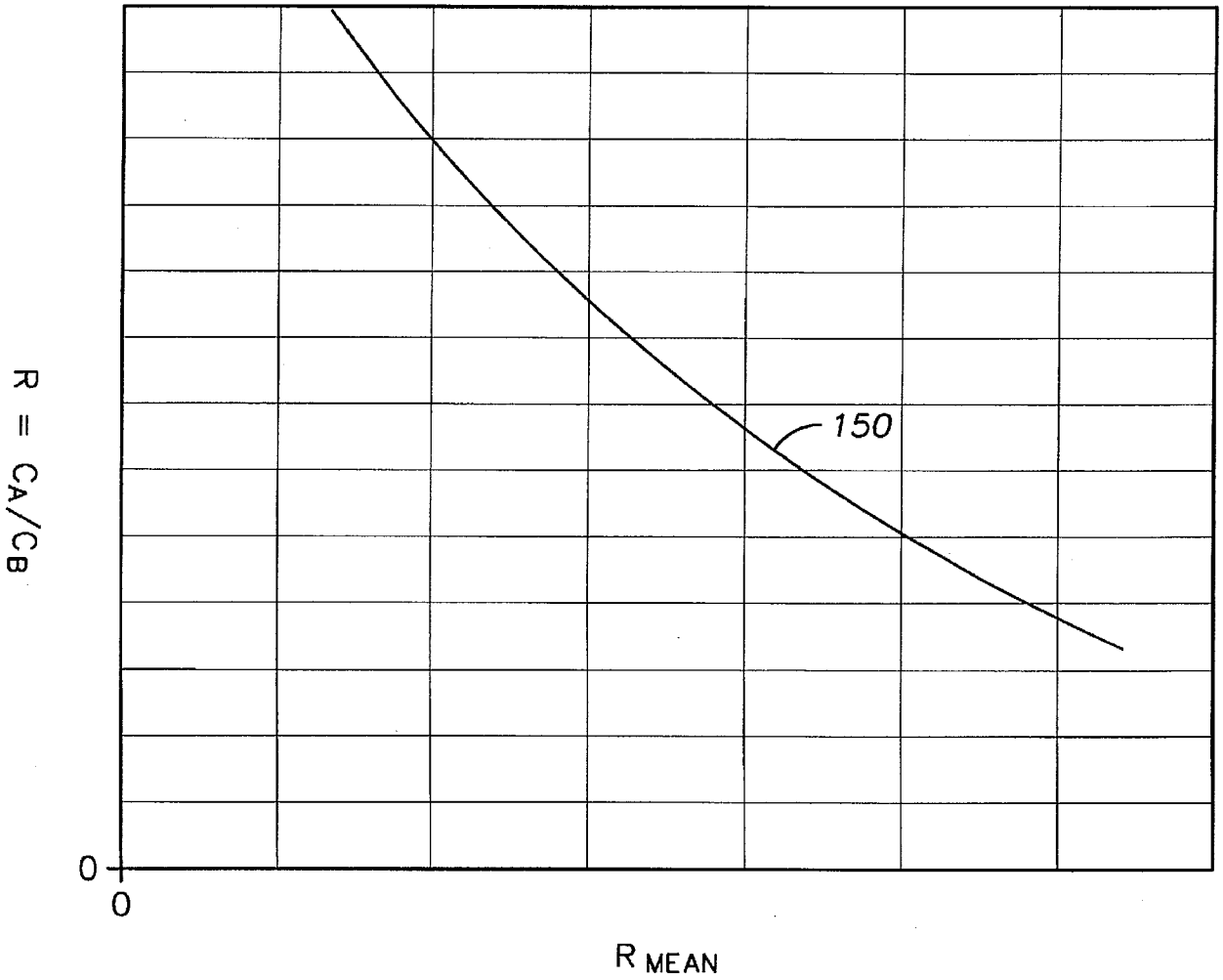
FIG. 3 graphically illustrates the calibration of a gamma detector using a Compton based calculation to enable the determination of the radial location of radioactive tracer material during a fracturing treatment.

A typical example of a calibration curve 150 for the isotope Scandium$^{46}$ is illustrated in FIG. 3. Other commonly employed tracer isotopes show a similar response. Such calibration curves can then be stored in the random access memory of the programmed central processing unit 90 for use in subsequent signal processing of the spectral data signals. As illustrated in FIG. 3, such calibration curves give reliable "binary" information by indicating the presence of radioactive tracer material 125 at a radial location that is "near" or "far" from the gamma detector 45 thereby enabling the programmed central processing unit 90 to determine the presence or absence of radioactive tracer material 125 within the producing subterranean formation 20 at the depth location of the gamma detector 45.

It should be apparent, of course, that one potential component term in the above calculation of tracer penetration would be caused by residual tracer material in the borehole as well as being distributed radially outside the borehole into the formation. This borehole residual tracer would exhibit a very minimally downscattered spectrum and would weight the tracer penetration value to indicate the presence of tracer in the borehole near the tool. It can be shown, that in cased wells, this borehole tracer can be separately identified and, by proper selection of an interval of the well bore which contains only borehole tracers and no other, the effects of borehole tracers on the determination of the tracer penetration into the formation can be eliminated.

In cased hole situations, photoelectric adsorption is the most important mode of gamma ray attenuation for energies less than about 100 KeV. This process is dominated by the element with the highest atomic number (Z) located between the source of tracer gamma rays and the detector 45 in the logging tool 50. For tracer operations with the low-Z tool case, the Iron in the well casing has by far the highest atomic number Z of any significant downhole constituent. Thus the low energy portion of a tracer spectrum will be strongly influenced by whether or not the tracer gamma rays had to pass through the casing before reaching the detector 45.

Figure 4A:
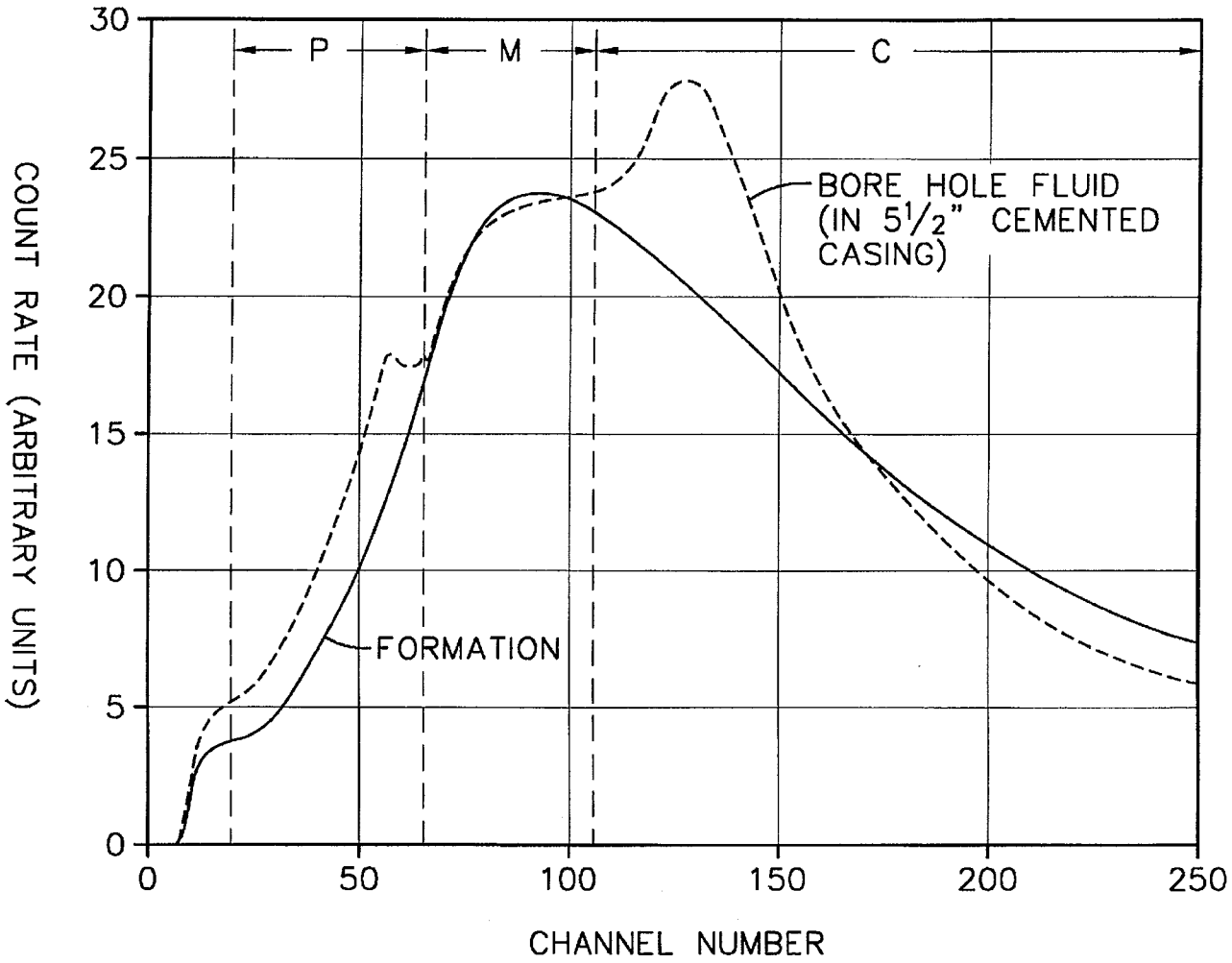
FIGS. 4*a* and 4*b* graphically illustrate formation, cement, and borehole spectra for $^{198}$Au, demonstrating the effects of photoelectric absorption.
Figure 4B:
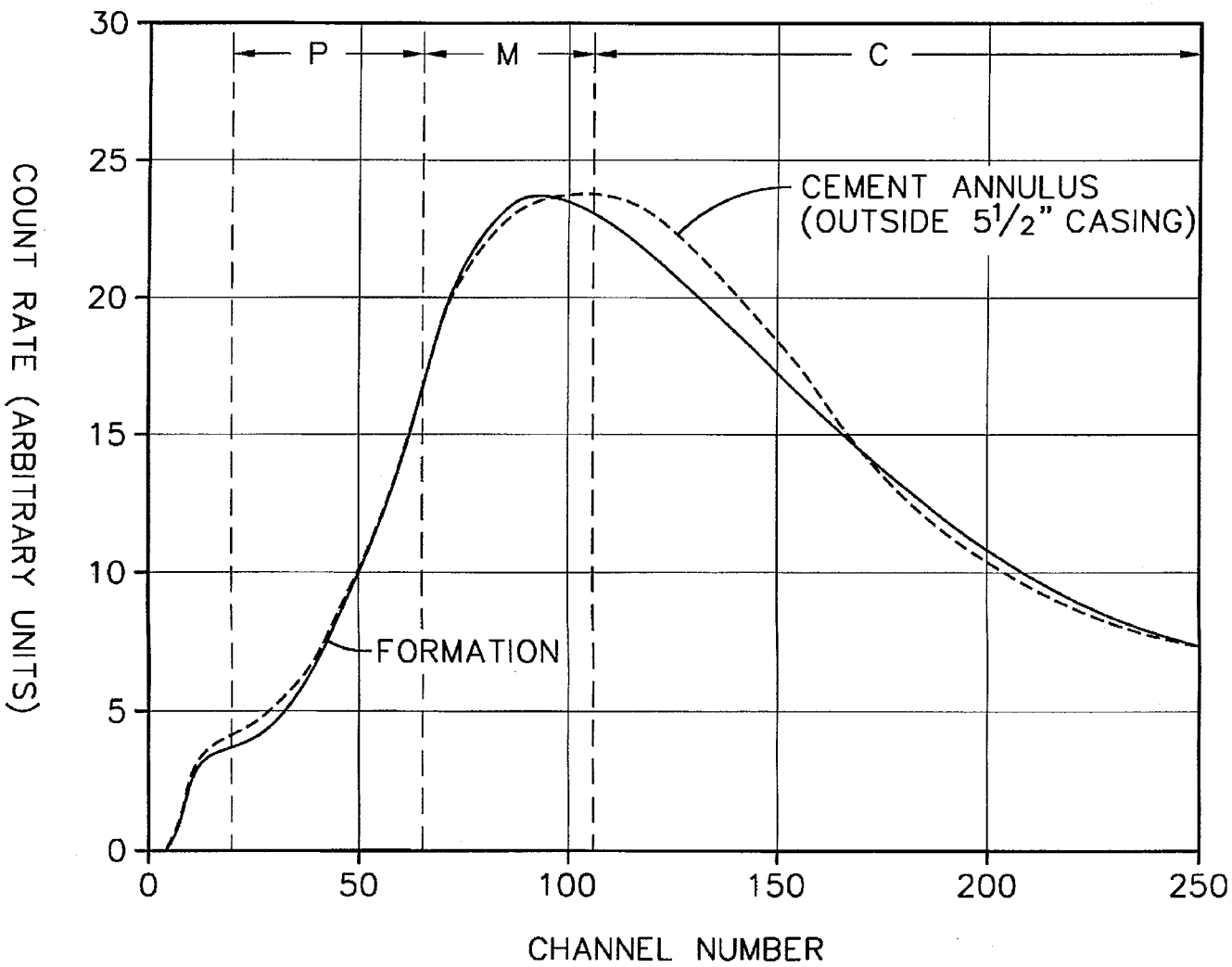

The low energy spectra (0–350 KeV) shown in FIGS. 4*a* and 4*b* illustrate the principles overlying the photoelectric measurement. The spectra overlaid in FIG. 4*a* show the difference in photoelectric absorption from $^{198}$Au gamma rays originating in the formation outside a cemented 5 ½" casing relative to those coming from inside the casing. The spectra can be visually divided into three energy ranges. The lowest range, P, is sensitive to photoelectric absorption differences caused by the casing. The mid-energy range, M, is a region for which the photoelectric absorption and the Compton downscattering effects are of nearly equal importance. The upper range, C, is that for which Compton scattering is significant and photoelectric absorption is negligible. A ratio, $R_p$, of gamma ray count rates in window M to those in window P is clearly photoelectrically sensitive and yet not markedly affected by Compton scattering effects. By similar illustration and comparison of Au$^{198}$ spectra from the formation versus the cement annulus surrounding the casing in FIG. 4*b*, it will be noted that significant spectral differences occur only in window C, which is dominated by Compton downscattering. Spectral shapes in windows M and P are essentially identical, hence $R_p$ is not highly sensitive to relative radial tracer distribution outside the casing.

Since a tracer in the borehole fluid would not have to penetrate the Iron casing in the wellbore to reach the detector 45, the observed count rates would show only minimal photoelectric absorption effects relative to count rams caused by any tracer originating outside the casing. Accordingly, if two low energy ranges of the tracer spectrum are chosen —one range "M" which is sensitive to Compton scattered radiation, and a region "P", a lower energy range, which is sensitive primarily to photoelectric absorption in Iron—the ratio of these count rates M/P will be a sensitive indicator of whether casing is present between the tracer source and the detector 45 and accordingly whether the tracer is inside or outside the casing.

Figure 5:
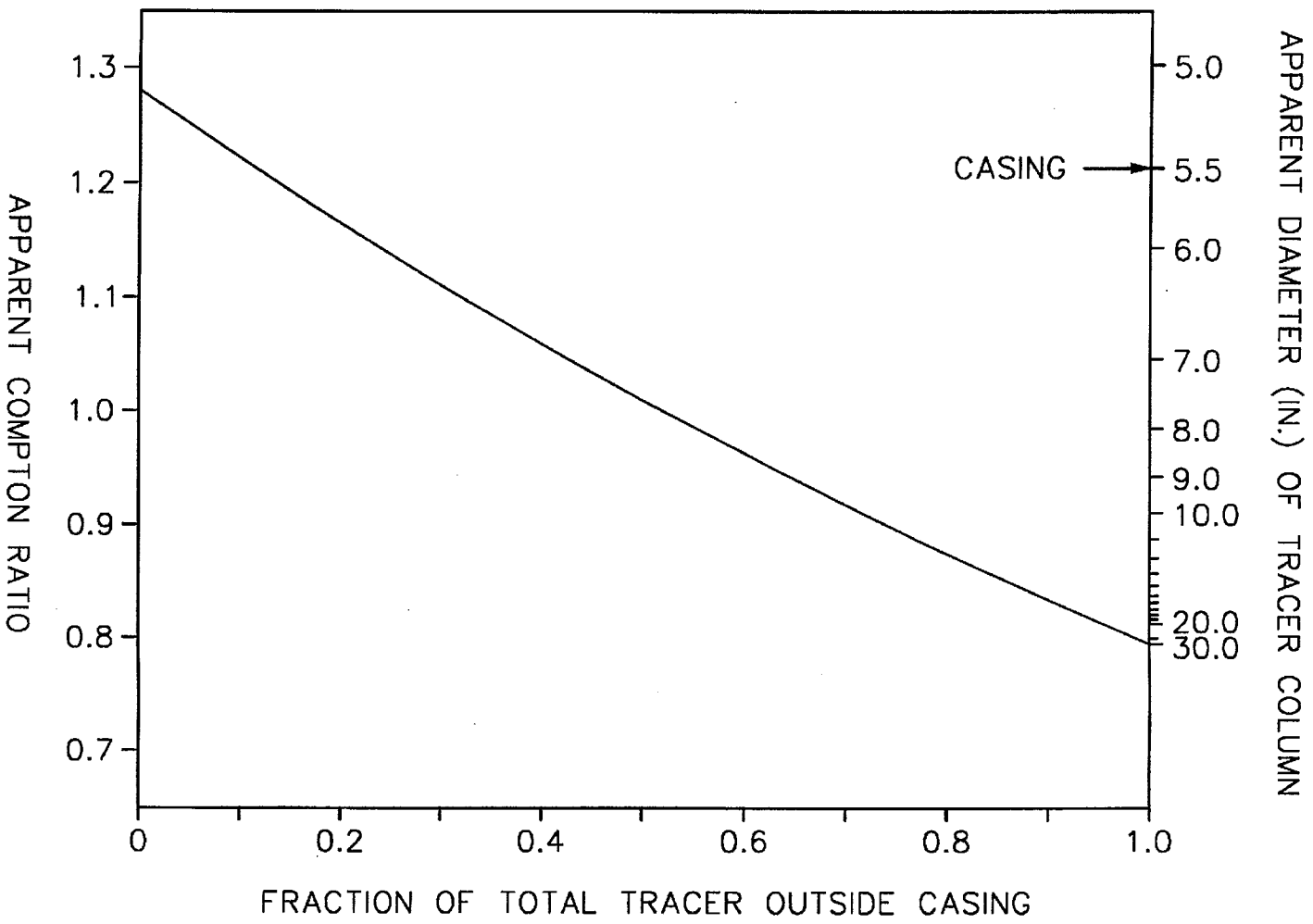
FIG. 5 graphically illustrates the calibration of a gamma detector using a Compton based calculation to enable the determination of the relative radial location of radioactive tracer material during a fracturing treatment.

It is apparent from the foregoing that if tracer is in the borehole then the photoelectric ratio M/P will be smaller in magnitude than if tracer were anywhere outside the casing. If tracer is present only in the formation, M/P will be greater in magnitude. For the situation where tracer is present in both the borehole and the formation, M/P will be intermediate these limits, dependent on the relative concentrations in each region. This relationship may be predetermined for a particular detector 45 and tracer isotope and thereby calibrated to enable a real-time determination of the relative concentration of tracer material within the borehole and within the formation. A typical calibration curve for a spectral gamma detector for the tracer isotope Scandium$^{46}$ is illustrated in FIG. 5. Such a calibration curve is then stored in the random access memory (RAM) of the CPU 90 for retrieval during a fracturing operation to provide real-time calculation of the relative concentration of the radioactive tracer material.

In the event that tracer material is located exclusively in the borehole, it is possible to further refine the method to compensate for borehole effects. The initial step is to measure the intensity and shape of the borehole spectrum where only borehole tracer is present. Then, assuming borehole tracer fluid is uniformly distributed in the borehole over the vertical interval logged, the spectrum could then be subtracted from the spectra in zones having both borehole and formation tracers, as evidenced by zones having a lower concentration of tracer within the formation. The radial position of tracer penetration can then be recalculated after the borehole count rate component has been removed from the spectra in the formations of interest to provide a more accurate radial position of tracer penetration which is sensitive only to radial formation effects.

In a preferred embodiment, the calibration of the gamma detector 45 and subsequent signal processing of the gamma ray spectral signals are performed substantially in accordance with the methods utilized in the TracerScan® logging service provided by Halliburton Energy Services, of Houston, Tx. In this manner, the programmed central processing unit 90 is able to process the corrected fracturing spectrum signal 140 to generate a fracture penetration signal representative of the presence or absence of the radioactive tracer material 125 actually within the producing subterranean formation 20 at the depth location of the gamma detector 45.

The ability to distinguish between radioactive tracer material within the producing subterranean formation 20, versus that which is not, is of substantial benefit to the monitoring of the fracture extension during the fracturing treatment. For example, for the situation where the gamma ray detector 45 is positioned above the point of injection at the fracturing depth L, as would be required where the adjacent subterranean formation for which a fracturing treatment would present undesirable water flow is positioned above the producing subterranean formation 20, and with the radioactive tracer material 125 injected by the fracture injection pump 100, as in the fourth embodiment illustrated in FIG. 6, there will always be radioactive tracer material 125 within the borehole 80 and surrounding the gamma ray detector 45. It is also possible for radioactive tracer material 125 to migrate in the borehole fluid either above or below the injection interval. Consequently, the ability to distinguish between radioactive tracer material 125 within the producing subterranean formation 20 and that which is not enhances real-time monitoring of the fracturing treatment in any situation encountered in practice.

In addition, the ability to quantify the actual or relative radial distance from the borehole allows for additional control over the fracturing treatment. For example, some well bores suffer from a poor cement job adjacent to the casing; in such wells, it may be important to know whether the fracturing fluid is penetrating the formation or merely passing through cracked cement just outside of the hole, which is a problem beyond that of fracturing "out of zone". The present method provides a monitoring technique to determine which of the possible paths the fracturing fluid is following in such a situation.

A fracture injection pump control signal, stopping the operation of the fracture injection pump 100, is then generated by the programmed central processing unit 90 when the fracture penetration signal 145 indicates the presence of radioactive tracer material 125 within the producing subterranean formation 20 at the depth location of the gamma detector 45.

In this manner, the fracture extension in the direction of an adjacent subterranean formation for which a fracturing treatment would present the possibility of an undesirable water flow in the borehole 80 from a water-productive subterranean formation 40 can be prevented by stopping the fracturing treatment once the fracture extension has progressed to a location adjacent to the adjacent subterranean formation.

Conventional signal processing methods can also be utilized to determine the presence or absence of the radioactive tracer material 125 within the producing subterranean formation 20 at the depth location of the gamma detector 45 for those situations where there is a minimal possibility of radioactive tracer material 125 being present within the borehole 80 during the fracturing treatment such as when the gamma detector 45 is positioned below the point of injection at the fracturing depth L and there is no leakage past the packer. Such methods rely upon a predetermined threshold level of the corrected fracturing spectrum signal 140 to indicate the presence or absence of radioactive tracer material 125 at the depth location of the gamma detector 45. However, in a preferred embodiment the Compton based calculation and associated calibration techniques are utilized to minimize errors in determining the fracture extension for the reasons previously discussed.

Figure 6:
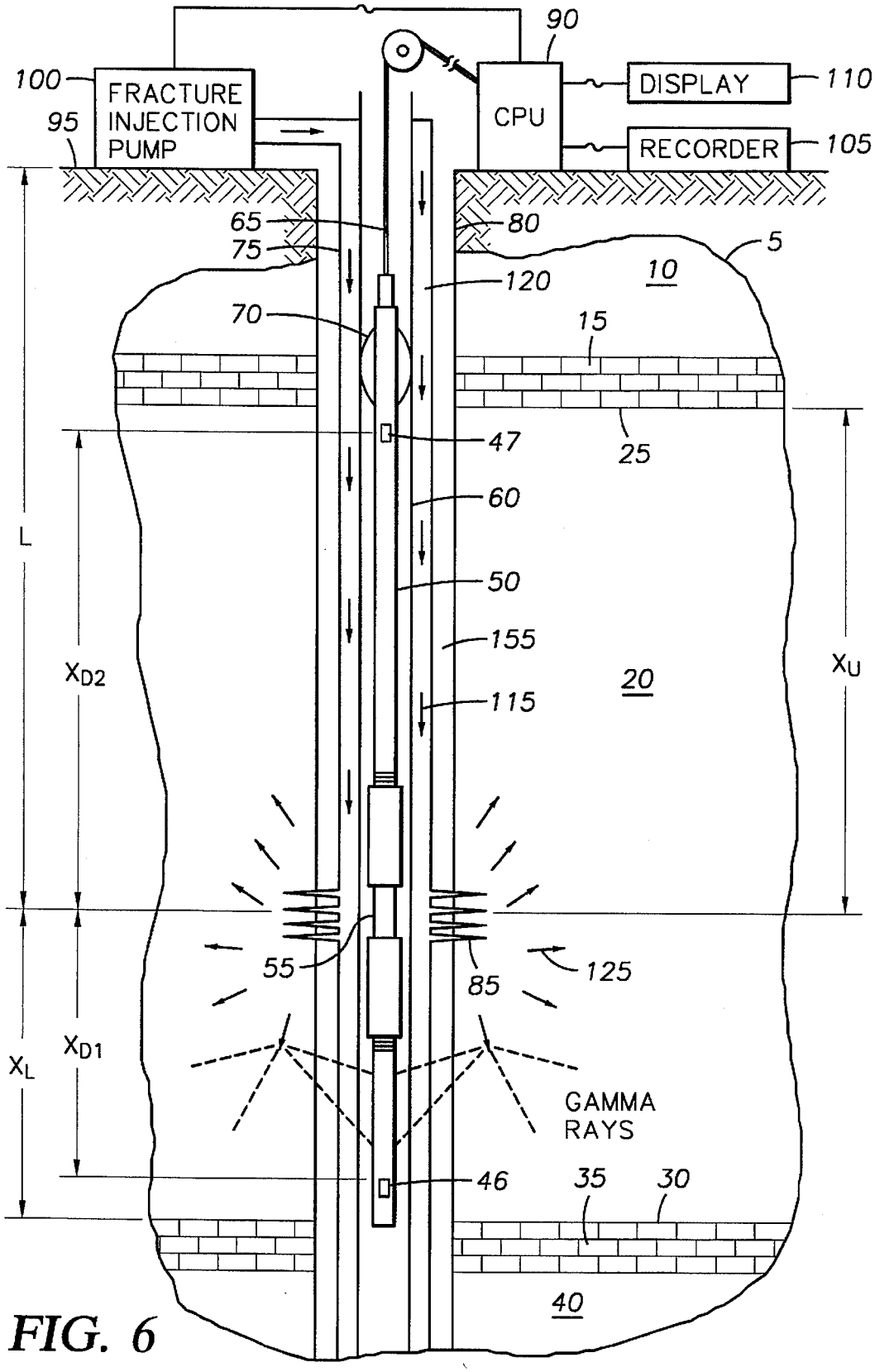
FIG. 6 schematically illustrates a second embodiment of the present invention.

Referring now to FIG. 6, a second embodiment of the present invention will now be described. Elements of the second embodiment with item numbers common to those used for the first embodiment are identical in nature and function unless otherwise indicated.

In the second embodiment, both the upper rock strata formation 15 and the lower rock strata formation 35 do not constitute extensive barriers to penetration by a fracturing treatment. Consequently a fracturing treatment "out of zone" will be of concern with respect to both the upper water-productive formation 10 and the lower water-productive formation 40, since a fracture of either the upper rock strata formation 15 or the lower rock strata formation 35 would introduce water flow from the water-productive formation 40 into the wellbore.

Therefore in order to prevent an "out of zone" fracturing treatment, the fracture extension in the direction of the upper rock strata formation 15 must be stopped short of the upper boundary 25, defined by the interface between the producing subterranean formation 20 and the upper rock strata formation 15, and the fracture extension in the direction of the lower rock strata formation 35 must be stopped short of the lower boundary 30, defined by the interface between the producing subterranean formation 20 and the lower rock strata formation 35.

In order to monitor the fracture extension in the direction of the lower rock strata formation 35 and thereby stop the fracturing operation before it reaches the lower rock strata formation 35, a first gamma detector 46 is positioned on the lower side of the logging tool 50, adjacent to the lower rock strata formation 35, and spaced apart from the conventional radioactive tracer injector 55, which is positioned at the injection point located at the fracturing depth L, by a distance $X_{D1}$. The distance $X_{D1}$ is selected to ensure that the fracturing operation is stopped once the fracture extension reaches a depth just short of the lower boundary 30 by detection of the presence of radioactive tracer material within the producing subterranean formation 20 at the depth location of the first gamma detector 45.

In order to monitor the fracture extension in the direction of the upper rock strata formation 15 and thereby stop the fracturing operation before it reaches the upper rock strata formation 15, a second gamma detector 47 is positioned on the upper side of the logging tool 50, adjacent to the upper rock strata formation 15, and spaced apart from the conventional radioactive tracer injector 55, which is positioned at the injection point located at the fracturing depth L, by a distance $X_{D2}$. The distance $X_{D2}$ is selected to ensure that the fracturing operation is stopped once the fracture extension reaches a depth just short of the upper boundary 25 by detection of the presence of radioactive tracer material within the producing subterranean formation 20 at the depth location of the second gamma detector 46.

Thus the distances $X_{D1}$ and $X_{D2}$ are selected to be approximately equal to the distances from the fracturing depth L to the boundary of the adjacent subterranean formations for which a fracturing treatment would present the possibility of undesirable water flow from water-productive formations. These distances may also be selected in response to selected characteristics of the producing subterranean formation 20, of the fracturing fluid, and the rate of injection of the fracturing fluid. In one exemplary embodiment, the distances $X_{D1}$ and $X_{D2}$ are selected to be 1 to 2 meters less than the distance from the fracturing depth L to the boundaries of the adjacent subterranean formations. Thus, for the formation 5, the distance $X_{D1}$ is selected to be 1 to 2 meters less than the distance $X_L$, from the fracturing depth L to the lower boundary 30 in order to provide an acceptable margin of safety, while the distance $X_{D2}$ is selected to be 1 to 2 meters less than the distance $X_U$ from the fracturing depth L to the upper boundary 25 in order to provide an acceptable margin of safety.

The first gamma detector 46 and the second gamma detector 47 being may be in nature and function as the gamma detector 45 previously described for use with the first embodiment.

In a preferred embodiment, the fracturing operation will be stopped whenever the presence of radioactive tracer material 125 is detected at the depth location of either the first gamma detector 46 or at the depth location of the second gamma detector 47. In this manner, the fracture extension may be monitored and thereby controllably limited both above and below the injection interval centered at the fracturing depth L.

Figure 7:
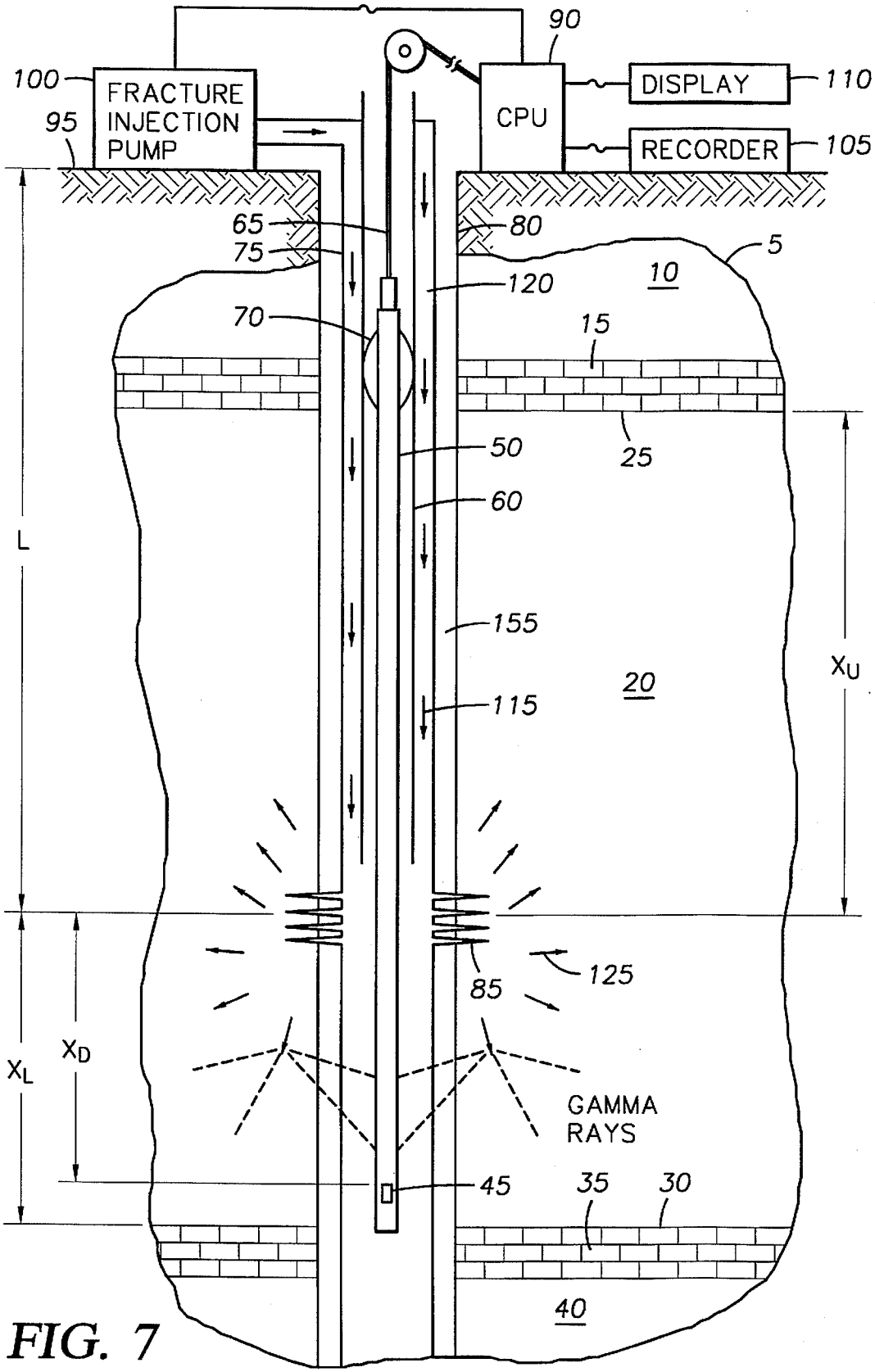
FIG. 7 schematically illustrates a third embodiment of the present invention.

Referring now to FIG. 7, a third embodiment of the present invention will now be described. Elements of the third embodiment with item numbers common to those used for the first embodiment are identical in nature and function unless otherwise indicated. In the third embodiment, the injection of radioactive tracer material 125 is provided by the fracture injection pump 100 positioned at the surface location 95 thereby eliminating the need for a tracer injector within the wellbore 80 at the fracturing depth L. The positioning of the gamma detector 45 is still determined relative to the fracturing depth L by means of the dimension $X_D$ as previously described for the first embodiment as the formation 5 has the same composition as that previously depicted and described for FIG. 1.

The steel tubing string 60 can extend beyond the point of injection at the fracturing depth L in the second embodiment as the fracture injection pump 100 injects the radioactive tracer material 125 at the surface.

Figure 8:
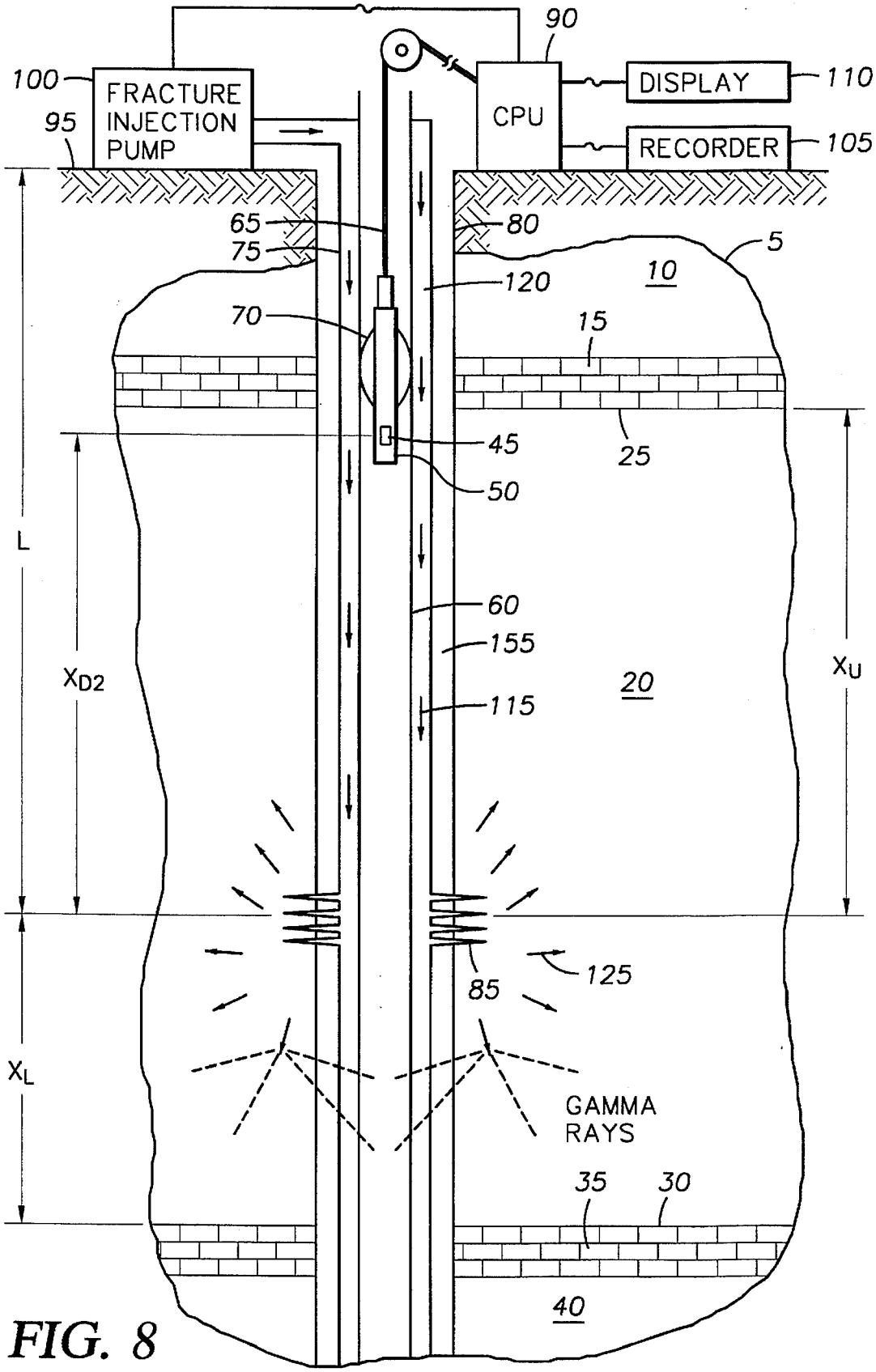
FIG. 8 schematically illustrates a fourth embodiment of the present invention.

Referring now to FIG. 8, a fourth embodiment of the present invention will now be described. The fourth embodiment is identical to the third embodiment except that the gamma detector 45 is now positioned above the injection point at the fracturing depth L. This configuration would be necessitated by a formation 5 for which the lower rock strata formation 35 consists of an extensive barrier to penetration by a fracturing treatment while the upper rock strata formation 15 does not. Consequently a fracturing treatment "out of zone" will primarily only be of concern with respect to the upper water-productive formation 10 since a fracture of the upper rock strata formation 15 would introduce water flow from the water-productive formation 10 into the wellbore 75.

For the embodiment illustrated in FIG. 8, with the injection of the radioactive tracer material 125 by the fracture injection pump 100 located at the surface location 95, there will always be radioactive tracer material 125 within the borehole 80 at the depth location of the gamma detector 45. Consequently, the gamma detector 45 will always detect the presence of radioactive tracer material 125 at the depth location of the detector 45 as the corrected fracturing spectrum 140 will always exhibit the presence of radioactive tracer material 125. However, the radioactive tracer material will be within the borehole 80, and the Compton downscattering signal will remain relatively constant, even though the absolute tracer count rate may vary due to variations in the injection rate at the surface, until the fracture extension reaches the depth location of the gamma detector 45. At this point, the Compton downscattering signal will shift thereby indicating the presence of radioactive tracer material 125 outside the borehole 80, and within the formation 5, at the depth location of the gamma detector 45.

Note that for this situation, conventional non-spectral signal processing of the gamma ray signals could give a false indication of the fracture extension during the fracturing treatment since such conventional methods do not distinguish between radioactive tracer material 125 within the producing subterranean formation 20 versus that which is not, since changes in the total gamma count rate could be caused by either the presence of radioactive tracer material in a fracture or by changes in the radioactive tracer concentration in the borehole.

Figure 9:
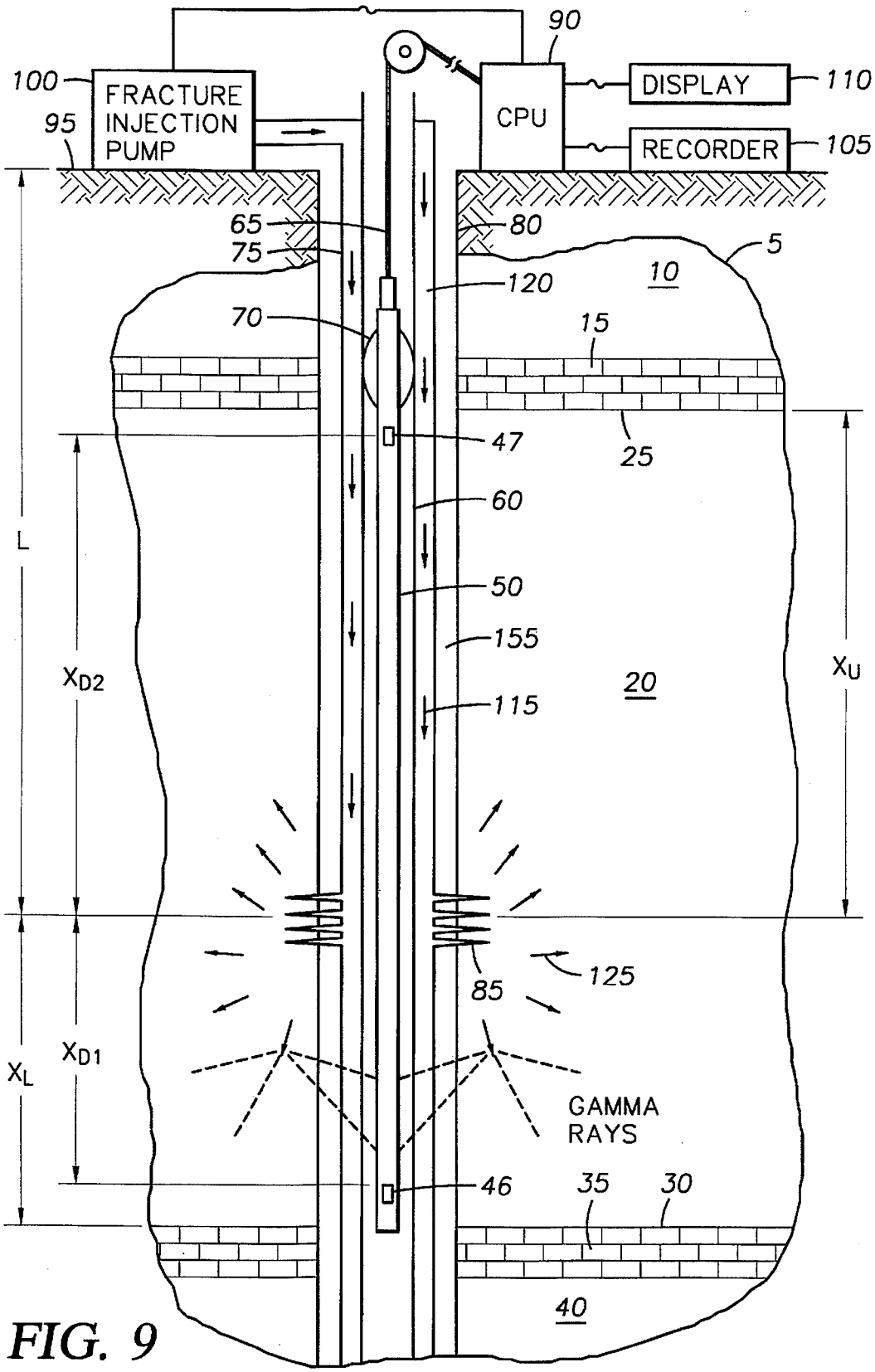
FIG. 9 schematically illustrates a fifth embodiment of the present invention.

Referring now to FIG. 9, a fifth embodiment of the present invention will now be described. Elements of the fifth embodiment with item numbers common to those used for the third embodiment (see FIG. 7) are identical in nature and function unless otherwise indicated.

In the fifth embodiment, both the upper rock strata formation 15 and the lower rock strata formation 35 do not constitute extensive barriers to penetration by a fracturing treatment. Consequently a fracturing treatment "out of zone" will be of concern with respect to both the upper water-productive formation 10 and the lower water-productive formation 40, since a fracture of either the upper rock strata formation 15 or the lower rock strata formation 35 would introduce water flow from the water-productive formation 40 into the wellbore.

Therefore in order to prevent an "out of zone" fracturing treatment, the fracture extension in the direction of the upper rock strata formation 15 must be stopped short of the upper boundary 25, defined by the interface between the producing subterranean formation 20 and the upper rock strata formation 15, and the fracture extension in the direction of the lower rock strata formation 35 must be stopped short of the lower boundary 30, defined by the interface between the producing subterranean formation 20 and the lower rock strata formation 35.

In order to monitor the fracture extension in the direction of the lower rock strata formation 35 and thereby stop the fracturing operation before it reaches the lower rock strata formation 35, a first gamma detector 46 is positioned on the lower side of the logging tool 50, adjacent to the lower rock strata formation 35, and spaced apart from the conventional radioactive tracer injector 55, which is positioned at the injection point located at the fracturing depth L, by a distance $X_{D1}$. The distance $X_{D1}$ is selected to ensure that the fracturing operation is stopped once the fracture extension reaches a depth just short of the lower boundary 30 by detection of the presence of radioactive tracer material within the producing subterranean formation 20 at the depth location of the first gamma detector 45.

In order to monitor the fracture extension in the direction of the upper rock strata formation 15 and thereby stop the fracturing operation before it reaches the upper rock strata formation 15, a second gamma detector 47 is positioned on the upper side of the logging tool 50, adjacent to the upper rock strata formation 15, and spaced apart from the conventional radioactive tracer injector 55, which is positioned at the injection point located at the fracturing depth L, by a distance $X_{D2}$. The distance $X_{D2}$ is selected to ensure that the fracturing operation is stopped once the fracture extension reaches a depth just short of the upper boundary 25 by detection of the presence of radioactive tracer material within the producing subterranean formation 20 at the depth location of the second gamma detector 46.

Thus the distances $X_{D1}$ and $X_{D2}$ are selected to be approximately equal to the distances from the fracturing depth L to the boundary of the adjacent subterranean formations for which a fracturing treatment would present the possibility of undesirable water flow from water-productive formations. These distances may also be selected in response to selected characteristics of the producing subterranean formation 20, of the fracturing fluid, and the rate of injection of the fracturing fluid. In one exemplary embodiment, the distances $X_{D1}$ and $X_{D2}$ are selected to be 1 to 2 meters less than the distance from the fracturing depth L to the boundaries of the adjacent subterranean formations. Thus, for the formation 5, the distance $X_{D1}$ is selected to be 1 to 2 meters less than the distance $X_L$ from the fracturing depth L to the lower boundary 30 in order to provide an acceptable margin of safety, while the distance $X_{D2}$ is selected to be 1 to 2 meters less than the distance $X_U$ from the fracturing depth L to the upper boundary 25 in order to provide an acceptable margin of safety.

The first gamma detector 46 and the second gamma detector 47 being identical in nature and function as the gamma detector 45 previously described for use with the first embodiment.

In a preferred embodiment, the fracturing operation will be stopped whenever the presence of radioactive tracer material 125 is detected at the depth location of either the first gamma detector 46 or at the depth location of the second gamma detector 47. In this manner, the fracture extension may be monitored and thereby controllably limited both above and below the injection interval centered at the fracturing depth L.

In addition to sand-slurry fracturing, as described above, other forms of fracturing fluids can be monitored in real time by the system employed in the present method. For example, it is common to apply acidizing treatments to formations, particularly in wells where sand-fracturing treatments are inappropriate. Acid can be pumped at high pressure to create forced fracturing or it can be injected at lower pressure to cause the rock to dissolve, either delivery method creates crevasses through which oil and gas can flow, thus stimulating the reservoir and enhancing fluid recovery. Consequently, for these purposes, the term "fracturing fluid" is intended to encompass any fluid that causes subterranean formation rock to fracture or dissolve, including water, steam, polymer mixtures, fluid-proppant mixtures, acidizing materials, and any other fluids, gases, or gels used to enhance oil recovery. Before injection, such fracturing fluids are conventionally mixed with proppants, merely diluted with water, or combined with other materials.

A method for monitoring the hydraulic fracturing of a producing subterranean formation has been described for use in oil and gas exploration. The method provides real-time monitoring of the fracture extension during a fracturing treatment through the use of a gamma detector positioned adjacent to a formation for which "out of zone" treatment is of concern. The method further provides real-time monitoring of the fracture extension during a fracturing treatment through the use of a pair of gamma detectors, one positioned above the fracturing interval and one positioned below the fracturing interval, each positioned adjacent to a formation for which "out of zone" treatment is of concern. The method thereby provides a means of preventing "out of zone" fracture treatment.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the claims.

What is claimed is:

1. A method for monitoring the hydraulic fracturing of an earth formation traversed by a well borehole, comprising:

pumping a fracturing fluid into said formation at a first predetermined depth in said borehole to hydraulically fracture said formation;

conveying a tracer material down said borehole in a sealed container, said container including a means for selectively introducing said tracer material into a fluid, said tracer material including at least one tracer element;

introducing said tracer material into said fracturing fluid at a depth in said borehole proximate said first predetermined depth;

monitoring gamma radiation from said tracer material at a second predetermined depth in said borehole during said pumping, wherein said second predetermined depth is determined in reference to a depth in said borehole beyond which formation fractures are desired to not extend; and processing said monitored gamma radiation to distinguish between a presence of said tracer material within said borehole and a presence of said tracer material within said formation.

2. The method of claim 1, further comprising:

measuring background radiation at said second predetermined depth in said borehole prior to the introduction of said tracer into said fracturing fluid.

3. The method of claim 2, further comprising:

correcting said monitored gamma radiation at said second predetermined depth for said measured background radiation proximate said second predetermined depth.

4. The method of claim 1, wherein said first predetermined depth is determined by perforations through a casing in said borehole.

5. The method of claim 1, wherein said tracer material comprises a plurality of tracer elements.

6. The method of claim 1, further comprising:

monitoring gamma radiation from said tracer material at a third predetermined depth in said borehole during said pumping, wherein said third predetermined depth is determined in reference to a depth in said borehole beyond which formation fractures are desired to not extend.

7. The method of claim 6, wherein said second predetermined depth is positioned above said first predetermined depth, and wherein said third predetermined depth is positioned below said first predetermined depth.

8. The method of claim 6, further comprising:

measuring background radiation in said borehole proximate said third predetermined depth prior to the introduction of said tracer into said fracturing fluid.

9. The method of claim 8, further comprising:

correcting said monitored gamma radiation at said third predetermined depth for said measured background radiation proximate said third predetermined depth.

10. A method for monitoring the hydraulic fracturing of a subterranean formation traversed by a well borehole, comprising:

fracturing said subterranean formation by pumping a mixture of a fracturing fluid and a proppant to create hydraulic pressure on said formation at a predetermined fracturing depth within said borehole;

conveying a radioactive tracer material down in a sealed container proximate to said predetermined fracturing depth, said container containing means for injecting said tracer material into said fracturing fluid;

detecting a gamma ray spectrum of said radioactive tracer material at a first predetermined depth in said borehole while said mixture is being pumped;

processing said gamma ray spectrum detected at said first predetermined depth to determine a presence of said radioactive tracer material within said borehole and said presence of said radioactive tracer material within said subterranean formation at said first predetermined depth; and stopping said fracturing of said subterranean formation when said presence of said radioactive tracer material is determined within said subterranean formation at said first predetermined depth.

11. The method of claim 10, further comprising:

detecting a background spectrum at said first predetermined depth in said borehole.

12. The method of claim 11, further comprising:

subtracting said background spectrum detected at said first predetermined depth from said gamma ray spectrum detected at said first predetermined depth to generate a corrected fracturing spectrum at said first predetermined depth.

13. The method of claim 12, wherein processing said gamma ray spectrum detected at said first predetermined depth comprises:

processing said corrected, corrected fracturing spectrum at said first predetermined depth to determine said presence of said radioactive tracer material within said formation and to distinguish between said presence of said radioactive tracer material within said borehole and said presence of said radioactive tracer material within said subterranean formation at said first predetermined depth.

14. The method of claim 10, wherein processing said gamma ray spectrum detected at said first predetermined depth comprises:

processing said gamma ray spectrum detected at said first predetermined depth to determine said presence of said radioactive tracer material within said formation and to distinguish between said presence of said radioactive tracer material within said borehole and said presence of said radioactive tracer material within said subterranean formation at said first predetermined depth by means of a predetermined relationship between said gamma ray spectrum detected at said first predetermined depth and a relative radial location of said radioactive tracer material.

15. The method of claim 10, wherein processing said detected spectrum at said first predetermined depth comprises:

processing said detected spectrum at said first predetermined depth to determine said presence of said radioactive tracer material within said formation and to distinguish between said presence of said radioactive material within said borehole and said presence of said radioactive material within said subterranean formation at said first predetermined depth by means of a calculated ratio between gamma rays detected in differing energy ranges of detected gamma ray spectra.

16. The method of claim 10, wherein processing said detected spectrum at said first predetermined depth comprises:

processing said detected spectrum at said first predetermined depth to determine said presence of said radioactive tracer material within said formation and to distinguish between said presence of said radioactive material within said borehole and said presence of said radioactive material within said subterranean formation at said first predetermined depth by a method of weighted-least-squares.

17. The method of claim 10, further comprising:

detecting a gamma ray spectrum of said radioactive tracer material at a second predetermined depth in said borehole while said mixture is being pumped.

18. The method of claim 17, wherein said second predetermined depth is positioned above said predetermined fracturing depth, and wherein said first predetermined depth is positioned below said predetermined fracturing depth.

19. The method of claim 17, wherein said first predetermined depth is positioned above said predetermined fracturing depth, and wherein said second predetermined depth is positioned below said predetermined fracturing depth.

20. The method of claim 17, further comprising:

processing said gamma ray spectrum detected at said second predetermined depth to determine a presence of said radioactive tracer material within said subterranean formation and to distinguish between a presence of said radioactive material within said borehole and said presence of said radioactive material within said subterranean formation at said second predetermined depth.

21. The method of claim 20, further comprising:

stopping said fracturing of said subterranean formation when said presence of said radioactive tracer material is determined within said subterranean formation at said second predetermined depth.

22. The method of claim 20, further comprising:

detecting a background spectrum at said second predetermined depth within said borehole.

23. The method of claim 22, further comprising:

subtracting said background spectrum detected at said second predetermined depth from said gamma ray spectrum detected at said second predetermined depth to generate a corrected gamma ray spectrum at said second predetermined depth.

24. The method of claim 23, wherein processing said gamma ray spectrum detected at said second predetermined depth comprises:

processing said corrected gamma ray spectrum at said second predetermined depth to determine said presence of said radioactive tracer material within said formation and to distinguish between said presence of said radioactive material within said borehole and said presence of said radioactive material within said subterranean formation at said second predetermined depth.

25. The method of claim 20, wherein processing said gamma ray spectrum detected at said second predetermined depth comprises:

processing said gamma ray spectrum detected at said second predetermined depth to determine said presence of said radioactive tracer material within said formation and to distinguish between said presence of said radioactive material within said borehole and said presence of said radioactive material within said subterranean formation at said second predetermined depth by means of a predetermined relationship between said gamma ray spectrum at said second predetermined depth and a relative radial location of said radioactive tracer material.

26. The method of claim 10, wherein said radioactive tracer material comprises a plurality of radioactive tracer elements.

27. A method for monitoring the hydraulic fracturing of a subterranean formation traversed by a well borehole, comprising:

conveying radioactive tracer material in a container to a predetermined fracturing depth within said borehole, said container including means for introducing said radioactive tracer material into a fluid;

fracturing said subterranean formation by pumping a mixture of fracturing fluid and proppant into said borehole, to create hydraulic pressure on said subterranean formation at said predetermined fracturing depth within said borehole;

injecting said radioactive tracer material into said mixture at said predetermined fracturing depth;

detecting a gamma spectrum of said radioactive tracer material at a first predetermined depth while said mixture is being pumped;

processing said gamma spectrum detected at said first predetermined depth to determine a presence of said radioactive material within said subterranean formation and to distinguish between a presence of said radioactive tracer material within said borehole and said presence of said radioactive tracer material within said subterranean formation at said first predetermined location by means of a predetermined relationship between said gamma spectrum and a relative radial location of said radioactive tracer material; and stopping said fracturing of said subterranean formation when said presence of said radioactive tracer material is determined within said subterranean formation at said first predetermined depth.

28. A method for monitoring the hydraulic fracturing of a subterranean formation traversed by a well borehole, comprising:

conveying radioactive tracer material in a container down said borehole to a predetermined fracturing depth within said borehole, said container including means for infecting said radioactive tracer material into a fluid;

fracturing said subterranean formation by pumping a mixture of particles and fluid into said subterranean formation to create hydraulic pressure on said subterranean formation at a predetermined fracturing depth within said borehole;

injecting said radioactive tracer material into said mixture at said predetermined fracturing depth;

detecting a first gamma ray spectrum of said radioactive tracer material at a first predetermined depth while said mixture is being pumped;

detecting a second gamma ray spectrum of said radioactive tracer material at a second predetermined depth while said mixture is being pumped;

processing said first detected gamma ray spectrum to determine a presence of said radioactive tracer material within said subterranean formation and to distinguish between a presence of said radioactive tracer material within said borehole and said presence of said radioactive material within said subterranean formation at said first predetermined depth by means of a predetermined relationship between said first detected gamma my spectrum and a relative radial location of said radioactive tracer material;

processing said second detected gamma ray spectrum to determine a presence of said radioactive tracer material within said subterranean formation and to distinguish between a presence of said radioactive tracer material within said borehole and said presence of said radioactive tracer material within said subterranean formation at said second predetermined depth by means of a predetermined relationship between said second detected gamma ray spectrum and a relative radial location of said radioactive tracer material; and stopping said fracturing of said subterranean formation when said presence of said radioactive tracer material is determined within said subterranean formation at said first predetermined depth or at said second predetermined depth.

* * * * *